US005400820A

United States Patent [19]

Orth

[11] Patent Number: 5,400,820

[45] Date of Patent: Mar. 28, 1995

[54] LIGHT SWITCHING APPARATUS

[76] Inventor: George M. Orth, 2524 N. Harrison, #15, Shawnee, Okla. 74801

[21] Appl. No.: 185,205

[22] Filed: Jan. 24, 1994

[51] Int. Cl.[6] ..... B67D 5/37

[52] U.S. Cl. ..... 137/560; 137/801; 200/DIG. 37

[58] Field of Search ..... 137/801, 560; 200/DIG. 30, DIG. 31, DIG. 37

[56] References Cited

U.S. PATENT DOCUMENTS

| | | | |
|---|---|---|---|
| 1,978,753 | 10/1934 | Lent | 200/DIG. 37 |
| 2,338,387 | 1/1944 | Whitman | 137/560 |
| 2,675,827 | 4/1954 | Craddock | 137/560 |
| 4,749,126 | 6/1988 | Kessener et al. | 239/12 |
| 4,901,922 | 2/1990 | Kessener et al. | 239/12 |
| 5,031,657 | 7/1991 | Stairs | 137/801 |

*Primary Examiner*—A. Michael Chambers
*Attorney, Agent, or Firm*—David L. Baker

[57] ABSTRACT

A light switching apparatus, including an electrical switch, a water faucet assembly, an attaching mechanism for affixing the switch to a water faucet lever, and a wiring mechanism for electrically connecting the switch to a lighting circuit.

Preferably, the electrical switch is a fiat, thumb-operated switch, and the water faucet lever has at least one fiat surface. The mechanism for attaching the electrical switch to the fiat surface of the water faucet lever includes a plurality of magnets attached to a bottom side of the electrical switch to affix it to the fiat surface of the water faucet lever.

3 Claims, 2 Drawing Sheets

LIGHT SWITCHING APPARATUS

BACKGROUND OF THE INVENTION

1. Field of the Invention

The present invention relates to an apparatus for switching a light on and off, wherein the apparatus is physically attached to a tap water faucet handle.

2. Description of the Related Art

U.S. Pat. No. 4,749,126 relates to a device for introducing light into a stream of liquid in order to provide a spectacular visual effect or to provide illumination.

U.S. Pat. No. 4,901,922 discloses a device for introducing light into a stream of liquid, the light intensity varying according to the temperature of the liquid, and was a continuation-in-part of a co-pending application, now U.S. Pat. No. 4,749,126.

SUMMARY OF THE INVENTION

It is sometimes necessary for an individual to gain access to running tap water in darkness. Normally, the individual must find his way to a light switch in darkness, risking physical injury by tripping over or bumping into unseen objects. With the present invention, a user need only locate the tap water faucet itself to switch on a light, allowing the user access to the tap water without the additional step of turning on a light switch at a remote location.

Accordingly, it is a principal object of the present invention to provide an apparatus which allows a user to simultaneously turn on a light and run tap water and, in a similar fashion, to simultaneously turn off a light and shut tap water off.

It is a further object of the invention to give the user the option of switching the light on without running the tap water and, conversely, to run the tap water without switching the light on.

The present invention achieves the above objects, among others, by providing, in one aspect, an apparatus for switching a light on and off. The apparatus includes an electrical switch, a water faucet assembly, an attaching mechanism for affixing the switch to a water faucet lever, and a wiring mechanism for electrically connecting the switch to a lighting circuit.

Preferably, the electrical switch is a fiat, thumb-operated switch, and the water faucet lever has at least one fiat surface. The mechanism for attaching the electrical switch to the fiat surface of the water faucet lever includes a plurality of magnets attached to a bottom side of the electrical switch to affix it to the flat surface of the water faucet lever.

In another aspect, the invention generally features an apparatus for switching a light on and off. The apparatus includes: an electrical switch, a water faucet assembly, a mechanism for attaching the electrical switch to a water faucet lever, a mechanism for electrically connecting the switch to a lighting circuit, and a rigid conduit member which protects electrical wiring running from the electrical switch. The conduit member extends longitudinally and axially along the water faucet lever.

Preferably, the electrical switch is a fiat, thumb-operated switch, and the water faucet lever has at least one fiat surface. The mechanism for attaching the electrical switch to the fiat surface of the water faucet lever includes a plurality of magnets attached to a bottom side of the electrical switch to affix it to the flat surface of the water faucet lever. The attaching mechanism also includes at least one clamping member, with the clamping member including a preformed, hose-type clamp.

The invention will now be described by way of a particularly preferred embodiment, reference being made to the accompanying drawings, wherein:

DESCRIPTION OF THE PREFERRED EMBODIMENT

Figure 1:
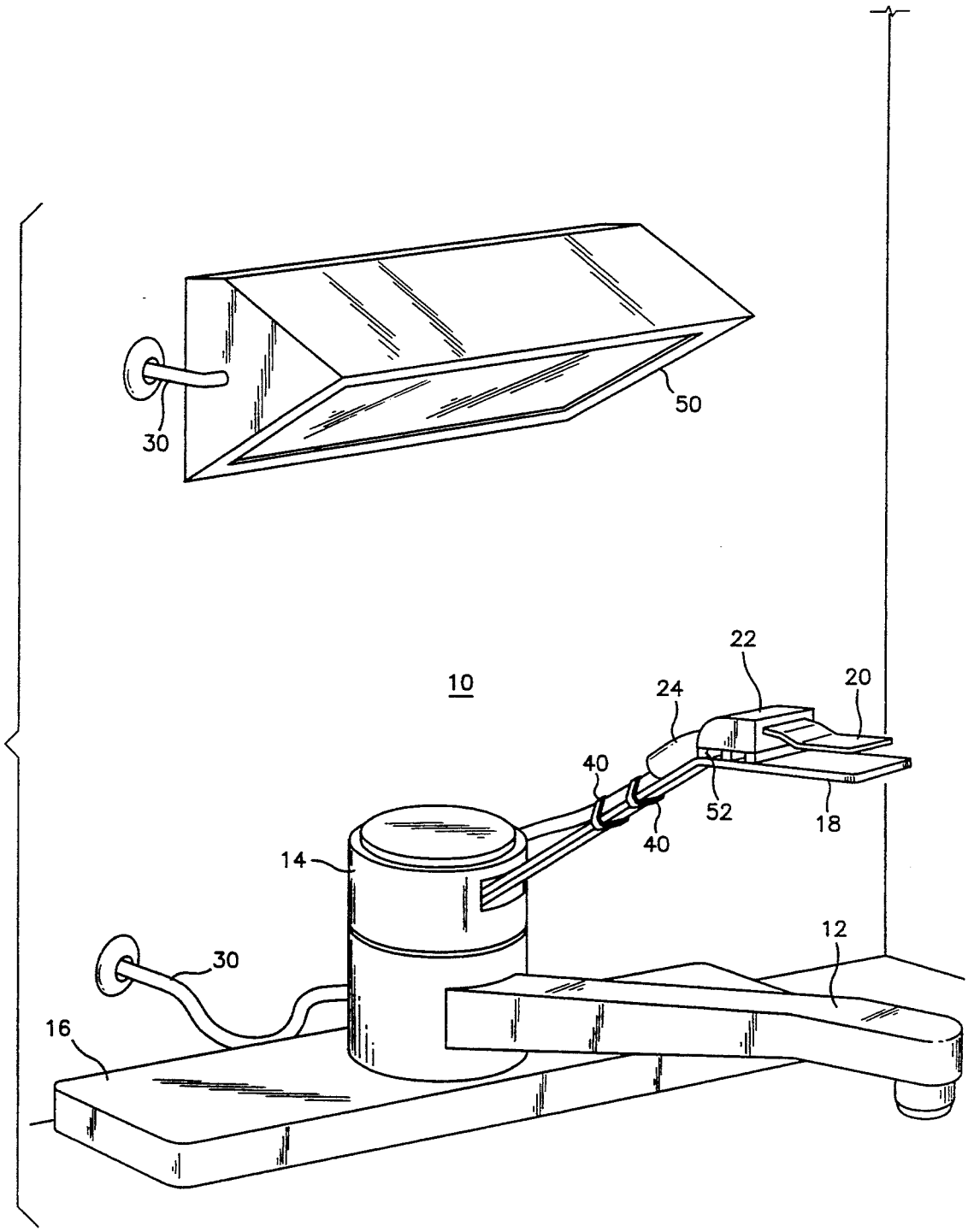
FIG. 1 is a perspective view of a domestic tap water faucet assembly, incorporating the light switching apparatus according to the present invention.
Figure 2:
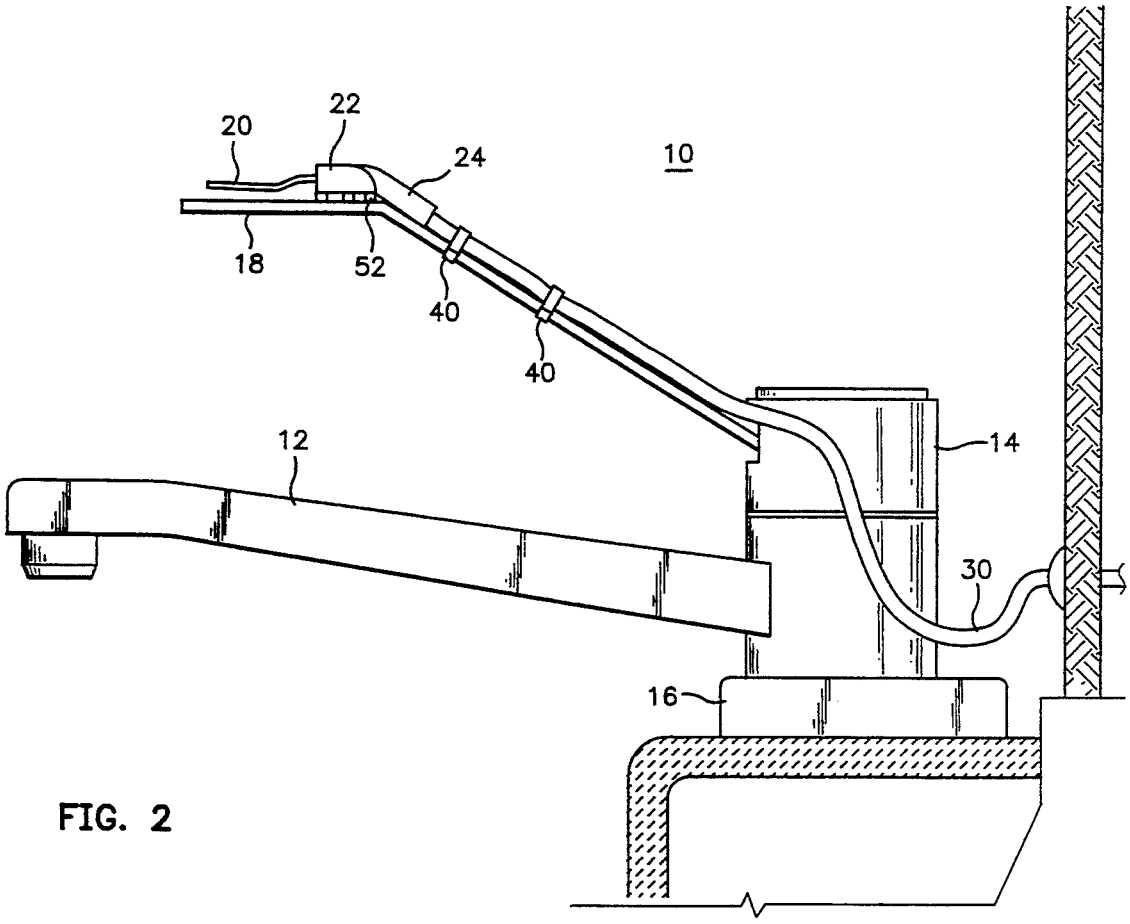
FIG. 2 is a left side elevational view of the light switching apparatus of FIG. 1.
Figure 3:
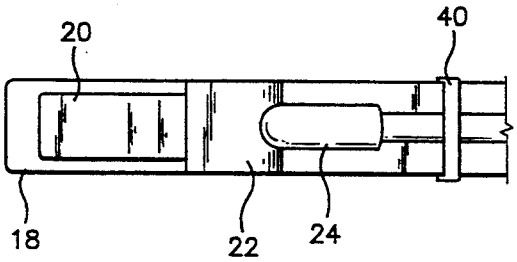
FIG. 3 is a fragmentary top view of the light switching apparatus of FIG. 1, illustrating how the thumb-operated electrical switch is firmly affixed by a clamping member to the tap water faucet lever.

FIG. 1 illustrates a light switching apparatus according to the present invention, generally indicated by the reference numeral 10. The light switching apparatus 10 comprises a tap water faucet assembly, an electrical switch 22, and electrical wiring 30. The tap water faucet assembly further includes a base member 16, a nozzle member 12, a rotatable valve housing member 14 for selecting hot or cold water, and a faucet lever 18 for turning tap water on and off.

Figure 4:
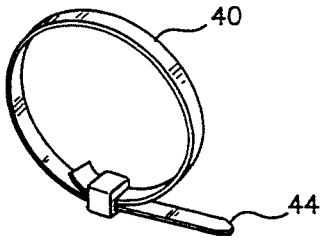
FIG. 4 is a perspective view of the preformed hose-type clamp which firmly affixes the electrical wiring to the tap faucet lever.

The electrical switch 22 is affixed to the flat surface of the faucet lever 18 by means of a plurality of magnets, as at 52, which are attached to the bottom surface of the switch 22. The magnets 52 should run longitudinally along the bottom of the switch 22 and perpendicular to the longitudinal axis of the flat portion of the faucet lever 18. Further, the wiring 30 extending from the switch 22 is held in place along the faucet lever 18 with the use of at least one preformed, hose type clamp 40. Referring now to FIG. 4, the clamp 40 is of a type well known in the mechanical arts and is typically constructed of stainless steel or other suitable material. The clamp 40 has a smooth inside diameter and is tensioned with the use of a tool which tightens a band 44 on the clamp 40. The band 44 is then cut, forming a dependable, permanent clamp 40. One example of such a suitable clamp is manufactured under the tradename of "BAND-IT".

Referring again to FIG. 1, electrical wiring 30 runs from the electrical switch 22 longitudinally and axially along the faucet lever 18. The wiring 30 is physically protected by a rigid conduit member 24 which surrounds the wiring 30 and which also extends longitudinally and axially along the faucet lever 18, beginning at a point where the wiring 30 enters the switch 22, and extending a length along the faucet lever 18, then terminating at a point before the faucet lever 18 enters the valve housing member 14.

The wiring 30 is electrically connected to a standard lighting unit 50 through a junction box, for example, or other suitable house wiring means. The lighting unit 50 is both energized and deenergized by manually depressing a switch lever 20 using the thumb and forefinger, the switch lever 20 actuating the electrical switch 22.

The switch 22 is preferably of the type well known in the art which is connected to an "on" position by a first actuation thereof and is turned to an "off" position by a second actuation of the switch 22. Additionally, the switch 22 is preferably of a substantially flat configuration; that is, the elements of the switch 22 are preferably contained within a shallow housing, allowing the switch 22 to be conveniently mounted on top of the faucet lever 18.

From FIG. 1, it may be seen that the function of switching a lighting unit 50 while simultaneously running tap water is accomplished by raising the faucet lever 18 with the forefinger and, at the same time, depressing the electrical switch lever 20 with the thumb.

It can also be seen that running tap water may be accomplished without switching the lighting unit 50 either on or off by raising the faucet lever 18 without engaging the electrical switch lever 20.

It can further be seen that the lighting unit 50 may be energized or deenergized without running tap water by manually depressing the electrical switch lever 20 while maintaing the faucet lever 18 in a stationary position.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. An apparatus for switching a light on and off, comprising:

(a) a flat, thumb-operated electrical switch;

(b) a water faucet assembly, including a faucet lever having at least one flat surface;

(c) a plurality of magnets removably attached to a bottom side of said electrical switch to affix said electrical switch to said at least one flat surface of said water faucet lever;

(d) wiring means for electrically connecting said switch to a lighting circuit;

(e) a rigid conduit member, said conduit member being connected to said electrical switch and said conduit member extending longitudinally and axially along said water faucet lever; and (f) electrical wiring extending from said electrical switch through said conduit member.

2. The apparatus according to claim 1, wherein said attaching means further comprises at least one clamping member to secure said electrical wiring to said faucet lever.

3. The apparatus according to claim 2, wherein said at least one clamping member comprises a preformed, hose-type clamp.

* * * * *